US005240247A

United States Patent [19]

Didier

[11] Patent Number: 5,240,247

[45] Date of Patent: Aug. 31, 1993

[54] RACQUET FOR BALL GAMES

[75] Inventor: Henry Didier, Lustenau, Austria

[73] Assignee: Head Sport Aktiengesellschaft, Kennelbach, Austria

[21] Appl. No.: 838,709

[22] PCT Filed: Jul. 15, 1991

[86] PCT No.: PCT/AT91/00087

§ 371 Date: Mar. 13, 1992

§ 102(e) Date: Mar. 13, 1992

[87] PCT Pub. No.: WO92/00781

PCT Pub. Date: Jan. 23, 1992

[30] Foreign Application Priority Data

Jul. 13, 1990 [AT] Austria ..... 1501/90

[51] Int. Cl.[5] ..... A63B 49/08

[52] U.S. Cl. ..... 273/73 J; 273/67 R; 273/81 R

[58] Field of Search ..... 273/67 R, 73 R, 73 J, 273/75, 81 R, 81 C

[56] References Cited

U.S. PATENT DOCUMENTS 4,033,583 7/1977 Ehrhart ..... 273/73 J X
4,609,198 9/1986 Tarr ..... 273/73 J
4,693,475 9/1987 Keilhau ..... 273/81 C X
5,088,734 2/1992 Glava ..... 273/73 J
5,135,223 8/1972 You ..... 273/73 X

FOREIGN PATENT DOCUMENTS

WO90/05567 5/1990 PCT Int'l Appl. .

*Primary Examiner*—V. Millin
*Assistant Examiner*—Raleigh W. Chiu
*Attorney, Agent, or Firm*—Nixon & Vanderhye

[57] ABSTRACT

A racquet for ball games, and in particular, a tennis racquet, includes a grip (2) and a head with a striking surface, in which the head is arranged to rotate to a limited degree in relation to the grip (2) about the longitudinal axis (7) of the grip (2). Spring and damping elements are fitted between the grip (2) and the head, and specifically, spring elements (13) and damping elements (14) are arranged in axially spaced pairs in the direction of the longitudinal axis (7) in each of a plurality of recesses (12) extending in the direction of the longitudinal axis (7) of the grip (2, 10) between the grip (2) and the shaft (5, 6) of the head in order to enable effective spring and damping of the torsional and longitudinal vibrations of the racquet (1) in the grip region.

15 Claims, 7 Drawing Sheets

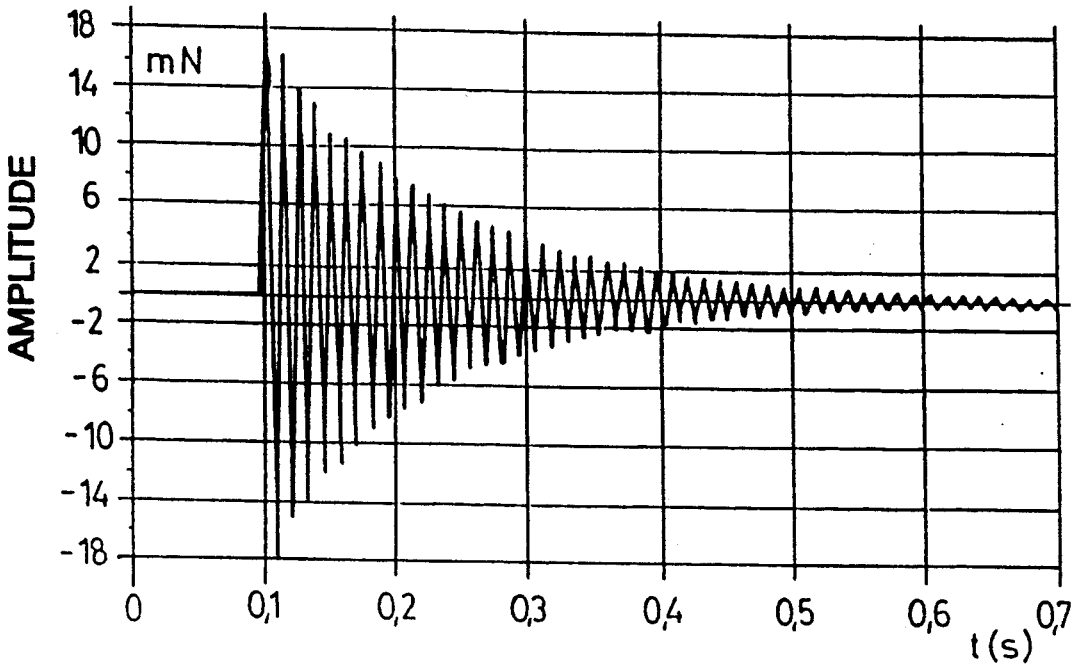
FIG. 5 (PRIOR ART)
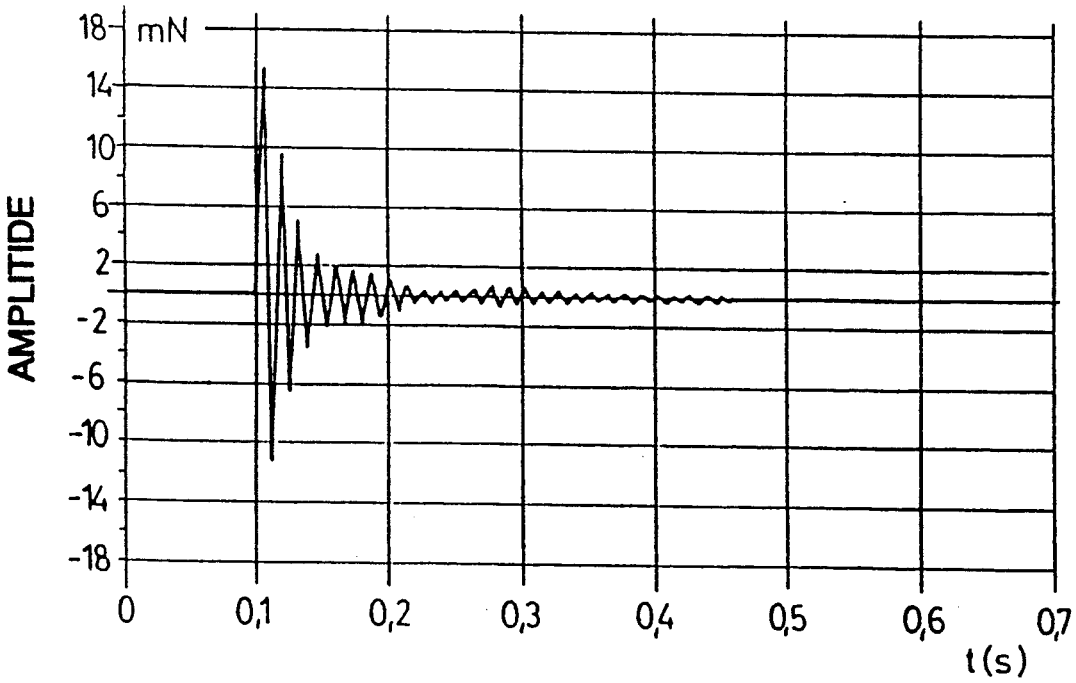
FIG. 6

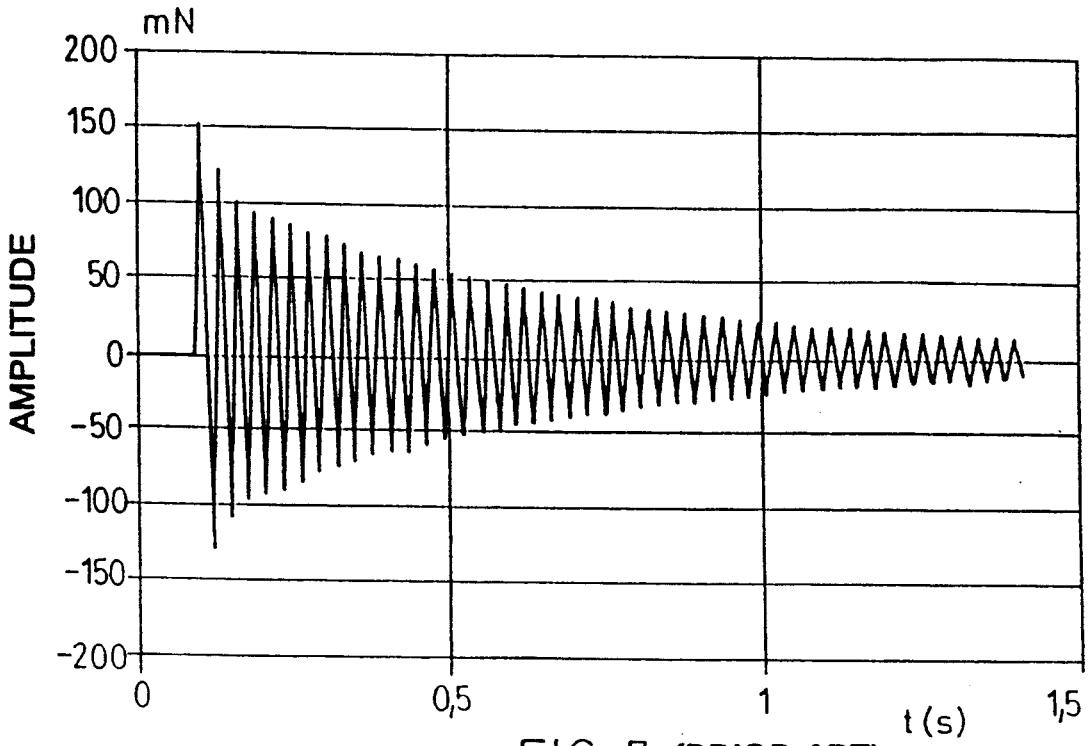
FIG. 7 (PRIOR ART)
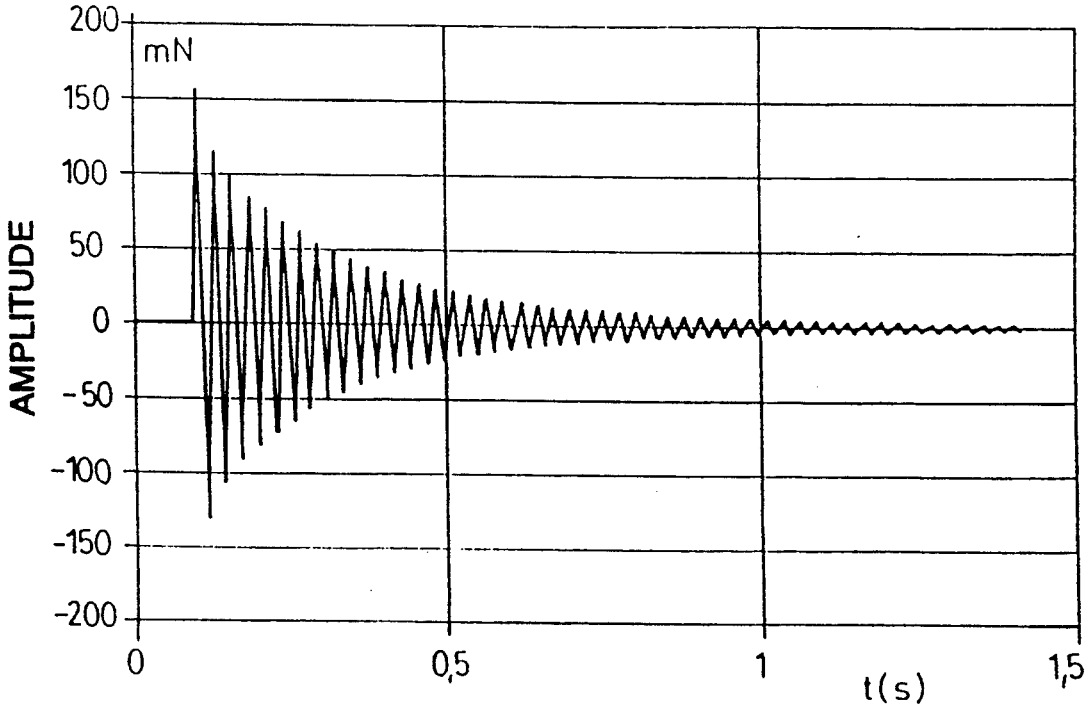
FIG. 8

RACQUET FOR BALL GAMES

The invention concerns a racquet for ball games, in particular a tennis racquet, having a grip and a head with a striking surface, wherein the head is arranged to rotate to a limited degree in relation to the grip about the longitudinal axis of the grip, and wherein spring and damping elements are fitted between the grip and the shaft of the head in recesses extending in the longitudinal direction of the grip.

GB Patent 30 153 A.D. 1909 disclose racquets, in particular cricket bats, hockey sticks or the like, which have a shaft wrapped with rubber, against which the grip can be pressed by inserting molded bodies. Wrapping the shaft with rubber is supposed to result in shock absorption 7hereby, depending on the properties of such rubber material, a certain degree of elasticity is attained. A significant damping cannot be readily achieved, however with rubber bands which are compressed. A tennis racquet of the above-noted type is described in WO 90/05567 in which rubber elastic bodies and bodies consisting of shock-absorbing material are inserted between the polygonal contour of a shaft and the also polygonal inside contour of a grip. In this known version, the head can be rotated to a limited degree relative to the grip about the longitudinal axis of the grip and about the nodal point of vibration in the grip area during an oscillation of the first order of the freely suspended racquet. The rubber elastic bodies and the shock-absorbing bodies were hereby staggered in relation to one another in peripheral direction of the grip, so that, on the whole, large-scale profiles had to be selected with smaller grip dimensions in order to ensure the required stability and rigidity of the shaft or grip.

It is now the object of invention to create a racquet of the above-noted type in which a sufficient springiness and damping can be ensured even with smaller grip dimensions, and without any significant reduction in the cross-section of the shaft. Moreover, it is possible to adjust the spring and damping properties to meet specific requirements. In addition, the invention aims to attain a springiness and damping in the grip area so that not only torsional vibrations can be effectively damped, but longitudinal vibrations can also be safely absorbed. To meet this object, the invention here relates to a racquet where separate spring and damping elements are placed, adjacent to one another, i.e., in pairs, each in the direction of the longitudinal axis of the grip, in each of a plurality of longitudinal recesses extending in direction of the longitudinal axis of the grip between the grip and the shaft of the head. As a result of the fact that, in addition to spring elements, separate damping elements are placed in a majority of recesses extending in longitudinal direction of the grip, it is first of all made possible to adjust the springiness and damping to one another by selecting the respective effective length of the spring or damping element, so that an effective damping is actually attained. By placing the spring and damping elements in the same recess, space is saved so that an effective springiness and damping also becomes possible with small grip dimensions without reducing the cross-section of the shaft. Due to the fact that spring and damping elements are placed adjacent to one another in axial direction in a common recess extending in longitudinal direction of the grip, an effective damping of pitching vibrations or longitudinal vibrations is at the same time made possible by appropriately arranging such spring and damping elements, whereby this damping of the longitudinal vibrations can be accurately adapted to the specific requirements independent of the damping of the torsional vibrations by axially positioning spring and damping elements accordingly. Advantageously, the object of the invention is essentially attained thereby that the spring elements and/or damping elements have lateral faces converging the axis of the grip, in particular, an essentially trapezoidal cross-section. Such spring or damping elements with convergent lateral faces or an essentially trapezoidal cross-section have the advantage, with respect to torsional vibrations, that the forces active with torsion are absorbed essentially normally on the lateral faces, so that the spring and damping properties are merely dependent on the selection of the appropriate material for the spring or damping elements, without these spring and damping properties being overlapped by frictional effects or by effects which cannot be exactly reproduced, such as for example a flexing action, of the spring or damping elements. Advantageously, therefore, it is constructed in such a way that faces of the grip and of the shaft of the head adjacent in peripheral direction of the grip, which faces interact with the spring and/or damping elements, lie in the planes convergent toward the longitudinal axis of the grip, in particular planes containing the longitudinal axis, as a result of which reproducible and accurately adjustable spring and damping properties are attained. Due to the essentially convergent or trapezoidal cross-section, an adjustment which is only dependent on the properties of the material is ensured with respect to the torsional vibrations, whereby, moreover, a high degree of damping is also attained in regard to the damping of longitudinal vibrations with an especially small cross-section due to this trapezoidal cross-section.

A number of elastomer plastics as well as synthetic rubbers can be considered as suitable materials for the spring as well as damping elements, whereby, advantageously, it is constructed in such a way that the spring elements consist of elastomer material, preferably polyurethane, and the damping elements consist of synthetic rubber having a lasser Shore hardness than the spring elements, in which, preferably, spring elements made of a material having a hardness (Shore A) of 78 to 88, in particular $84\pm2$, and damping elements made of a material having a hardness (Shore A) of 50 to 60, in particular, $55\pm2$, are used. In order to ensure a high degree of damping, it is simply necessary, with respect to the spring elements, to force the torsion or longitudinal vibration back into the original position. Advantageously, therefore, the object of the invention is attained thereby that the axial length of the spring elements is less than the axial length of the damping elements, adjacent in the same recess, whereby it has proven to be especially advantageous if the ratio of the length of the spring elements to the length of the damping elements is about 1:2.

In order to keep the extent of friction occurrences and the flexing effect as slight as possible, it is advantageously constructed in such a way that the base angle of the sides of the convergent cross-section of the sprign as well as the damping elements lies between 82° and 89.5°, whereby this type of a construction has proven to be especially advantageous, in particular, with respect to the exact adjustment and control of the damping of the torsional vibrations.

A further essential advantage which results from the arrangement of the invention of spring and damping elements in a common recess extending in longitudinal direction of the grip consists therein that only a slight additional weight is added to the grip by the spring and damping elements. Thus, it is furthermore possible to build racquets relatively light and avoid a cumbersome racquet grip. In each case, inserting spring and damping elements in a common recess extending in longitudinal direction of the grip leads to the surprising advantage that the measures taken for damping in the grip area do not in any way influence the vibration behaviour of the racquet and, thus, the basic construction of the ball racquet. The damping of vibrations extends exclusively to the grip, whereby the measured or precalculated vibration properties of the frame remain completely untouched by the damping features. To save even more weight, it is advantageously constructed in such a way that the length of the recesses for holding the spring and damping elements is greater than the sum of the lengths of the elements held in the same recess, whereby this type of a construction is especially advantageous, in particular, for the secure damping of longitudinal vibrations. In order to be able to safely absorb such longitudinal vibrations in the grip independent of the torsional vibrations, it is advantageously constructed in such a way that a spring and a damp element each are placed in the same axial recess in the vicinity of the axial ends /f the recess.

In each case, it is necessary for reliable damping of vibrations in the grip area to avoid a direct connection between shaft and grip along the entire length of the grip. Thus, it is advantageously constructed in such a way that the grip is only connected with the shaft of the head via spring and damping elements, whereby a secure hold of the grip can be advantageously attained by providing a shear resistant gluing of the elements with the faces interacting with the elements as protection against axial shifting of the grip relative to the shaft of the head.

A simple, axial fixing of the grip while allowing the grip to be disconnected from the shaft of the head to the greatest extent possible can, according to a preferred embodiment, be accomplished by connecting the shaft of the head and the grip to one another by pins or screws to ensure against axial shifting of the parts relative to one another, whereby the vibration behaviour and, in particular the damping thereof, is not influenced by the elastic pins or screws and the desired spring properties are also maintained. According to an especially preferred embodiment, to attain the desired spring and damping properties, it is constructed in such a way that elastic pins or screws, in particular made of polyamide, can be used in recesses in the shaft of the head and in the grip.

According to a preferred embodiment of the invention, to attain an increased rotary elasticity while avoiding play in axial direction, it is constructed in such a way that a sleeve is placed in recesses in the shaft to the head into which a locking pin engages, coming in contact with the inner wall of the sleeve in partial areas, and which is kept in recesses in the grip so as to be immovable. The locking pin or peg can thereby lie against the inside wall of the sleeve in its middle area so that limited rotation is made possible by a tapering at its end areas due to the distance from the inside wall of the sleeve.

The invention shall be described in greater detail in the following with reference to embodiments illustrated schematically in the drawings.

BRIEF DESCRIPTION OF THE DRAWINGS

FIGS. 5 and 6 are vibration diagrams of torsional vibrations of a ball racquet, the striking surface of which was acted upon eccentrically, in which FIG. 5 shows the vibrations of a ball racquet according to the prior art with a grip which does not have springs and is undamped, and FIG. 6 shows the vibrations of a racquet of the invention with spring and damping elements;

FIGS. 7 and 8 show the vibration conditions when a ball racquet vibrates longitudinally, in which FIG. 7 again shows the vibration conditions of a ball racquet as per the prior art without spring or damping elements and FIG. 8 shows the vibration conditions of a ball racquet of the invention using spring and damping elements;

DETAILED DESCRIPTION OF THE DRAWINGS

Figure 1:
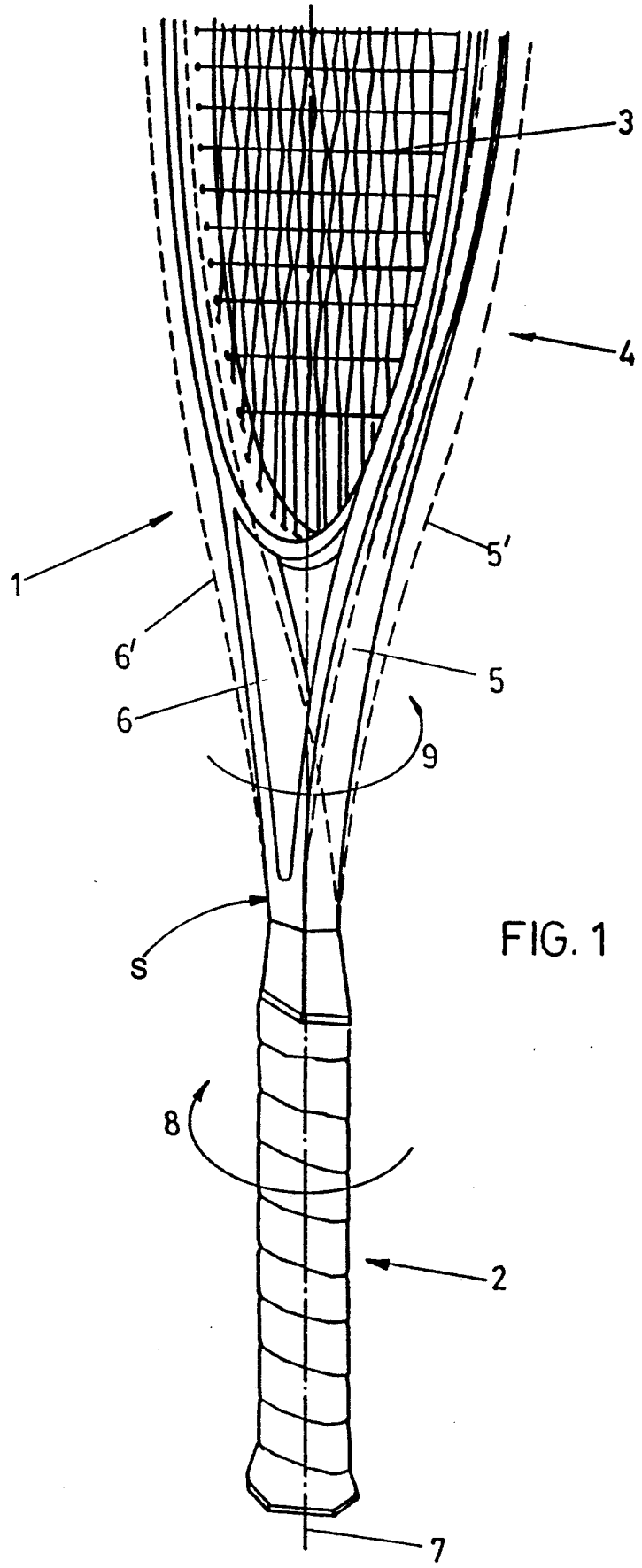
FIG. 1 shows a partial schematic view of a racquet of the invention for ball games.

In FIG. 1, a racquet for ball games is designated with 1, which is e.g. designed as a tennis racquet. Racquet 1 has a grip 2 as well as a head 4 having a striking surface 3, in which the striking surface is formed by a stringing in the illustrated tennis racquet. Head 4, the frame spars of which are designated with 5 and 6, is pinatable to a limited degree about longitudinal axis 7 of the racquet and the grip, as is indicated by the double arrows 8 and 9 as well as by contours 5' and 6' of the head 4 shown in broken lines. In addition to these types of torsional movements by an eccentric striking of the head, the racquet 1 is also subjected to longitudinal vibrations which are transmitted into the grip via frame spars 5 and 6 or the shaft portion 5 of the frame spars 5 and 6 (i.e., where the spars 5, 6 are joined together) dipping into grip 2.

Figure 2:
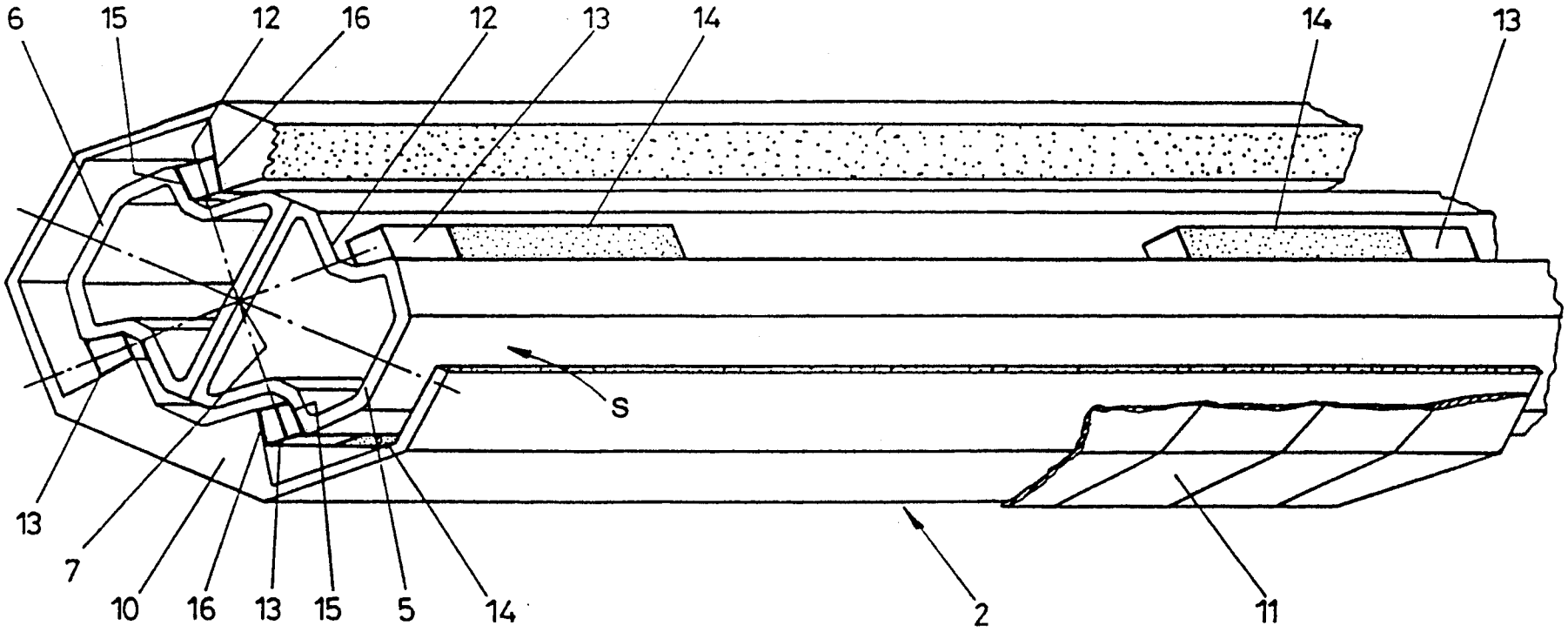
FIG. 2, in an enlarged illustration, shows a view of the grip of the racquet of the invention, partially in section.

It can be seen in the illustration in FIG. 2 how the shaft parts of the spars 5 and 6 are completely surrounded by a grip sleeve 10, in which a grip band 11, e.g. made of leather, is usually wound about the grip sleeve 10. Both the spars 5, 6 and the grip sleeve 10 have a polygonal contour such that recesses 12 are provided which extend in the direction of the longitudinal axis 7 of the grip or spars. A spring element 13 and a damping element 14 are placed at opposite ends of each recess 12, to one another adjacently in direction of the longitudinal axis 7. In this case, the spring elements 13 have a smaller axial length than the damping elements 14, whereby this length corresponds to a third up to about half of the length of the damping element 14. The overall length of the spring elements 13 and the damping elements 14 in any one recess 12 is thereby less than the overall length of the grip as well as the recess 12. To firmly fix the grip at the shaft as well as to advantageously absorb longitudinal vibrations, a combination each of a spring element 13 and a damping element 14 is placed in the vicinity of the axial end areas of the grip 2 as mentioned above. As can be clearly seen in FIG. 2, the grip or grip sleeve 10 is only connected with the shaft 5 of the head, i.e. with the spars 5 and 6, by insertion of the spring and damping elements 13, 14 such that the spring and damping elements 13 and 14 are each supported at the stay surfaces 15 of the shaft 5, adapted to mate with the outer contour of these elements 13, 14, at spars 5 or 6 as well as stay surfaces 16 inside the grip sleeve 10, as can be more clearly seen in FIG. 3.

The spring elements 13 are preferably made of elastomer material, in particular polyurethane, great hardness (Shore A) of e.g. approximately 84, whereas the damping elements are made of a synthetic rubber of lesser hardness (Shore A) of about 55.

Figure 3:
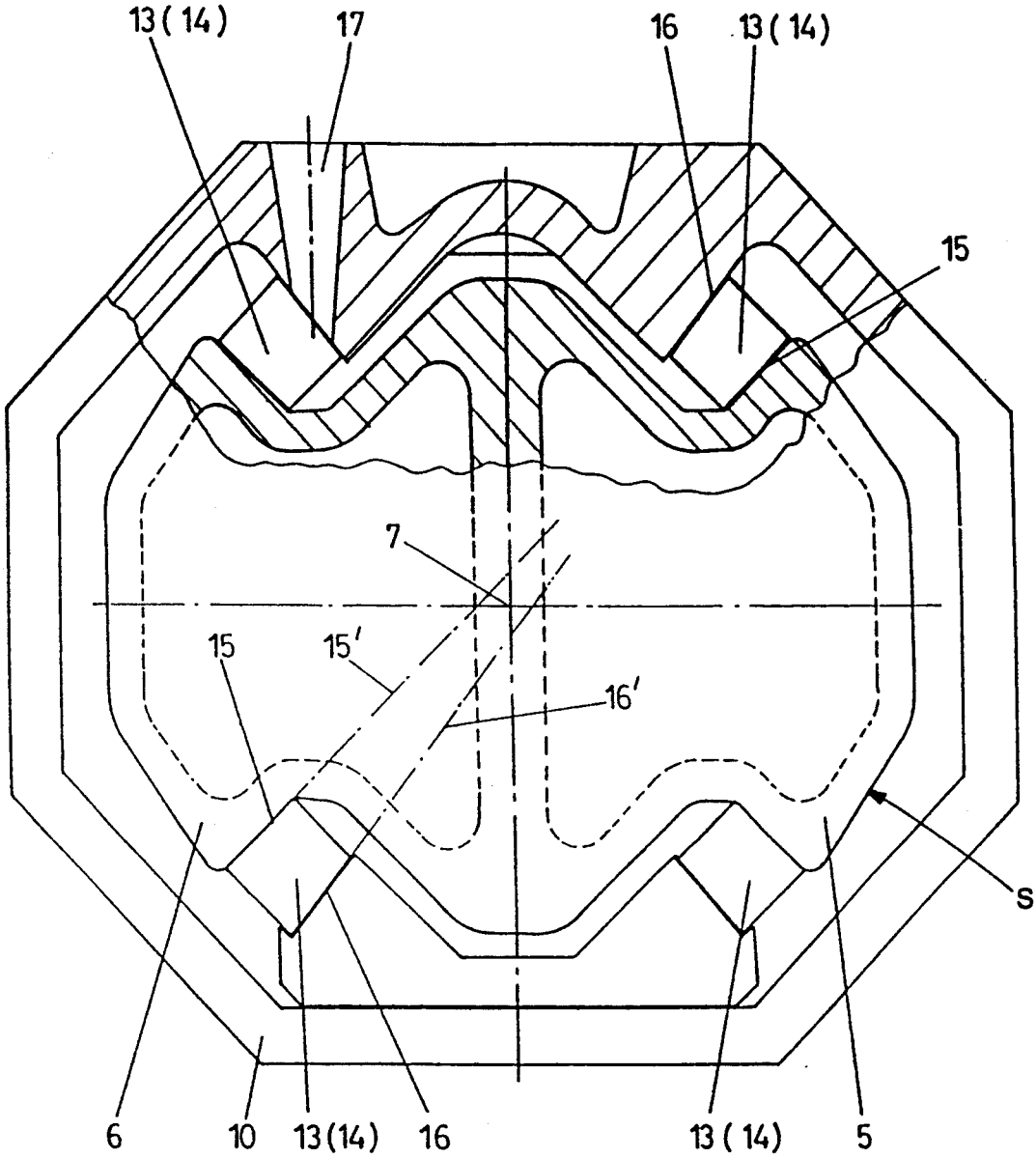
FIG. 3, again on an enlarged scale, shows a normal view on the grip shown in FIG. 2.

It can be seen in FIG. 3, how the frame spars 5, 6 or the shaft part 5 thereof are surrounded by the grip sleeve 10 with spring and damping elements 13 and 14 inserted. It can, furthermore, be clearly seen that the connection of the grip sleeve 10 or the grip with the spars 5, 6 is only done via these elements 13 and 14, since the outer contour of the spars 5, 6 do not come into contact with the inside contours of the grip sleeve 10 even with a turning movement about the longitudinal axis 7 of the racquet or grip 2, and also with longitudinal vibrations of the frame spars 5, 6 relative to the grip. In FIG. 3, an opening 17 in the grip sleeve 10 is indicated in the area of the spring and damping elements 13, 14 for letting in an adhesive for connecting the grip sleeve 10 with the frame spars. Each of such openings 17 for letting an adhesive in are provided in the area of the arrangement of damping and spring elements 13 and 14 distributed over the grip sleeve.

Figure 4:
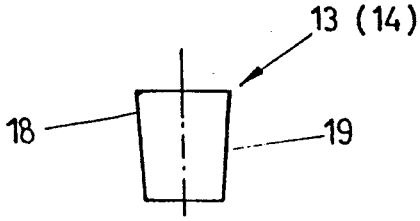
FIG. 4 is a cross-section of a spring or damping element.

It can be seen in FIGS. 3 and 4 that both the spring and damping elements 13 and 14 have an essentially trapezoidal cross-section, with lateral surfaces or faces 18 and 19 which lie in planes which are convergent in a direction toward the axis 7 of the grip 2, and such that a centerline through said spring elements and damping elements passes through the axis. Similarly, the faces 15 and 16 of the spars 5, 6 or grip sleeve 10, adjacent to the spring or damping elements 13, 14 or directly interacting with these, lie in the same planes as indicated by the lines 15' and 16' in FIG. 3. In other words the faces 18 and 19 of the spring or damping elements 13 and 14, interacting with these faces 15 and 16, have an angle of convergence adapted to the angle of inclination of the planes 15' and 16', as shown in FIG. 4.

In FIGS. 5 and 6, a comparison of the vibration behaviour is shown during a torsional vibration for a racquet as per the known prior art without spring and damping inserts (FIG. 5) and a racquet with spring and damping inserts 13, 14 between grip sleeve 10 and frame spars 5 and 6 (FIG. 6). The drastic reduction both of the amplitude and the duration of the vibrations can be clearly seen when using spring and damping elements.

In FIGS. 7 and 8, a similar comparison is shown for a racquet as per the known prior art (FIG. 7) and a racquet using spring and damping elements 13, 14 (FIG. 8), in which the quick reduction of the amplitude and the quick fading of the longitudinal vibration can again be clearly seen when using spring and damping elements placed adjacently between the shaft of the head and the grip in longitudinal direction thereof in a recess each.

Figure 9:
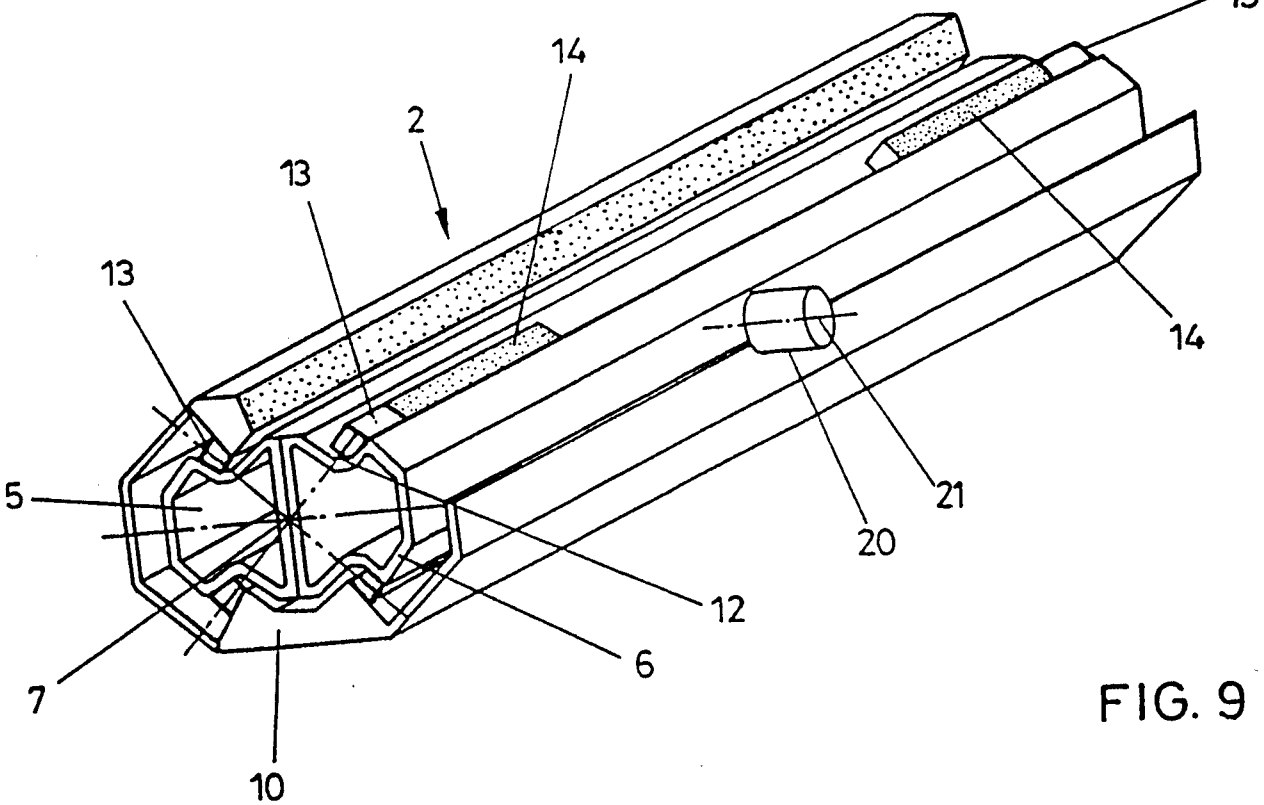
FIG. 9 is an illustration similar to FIG. 2, shows a modified embodiment of a grip of a racquet of the invention.

In the embodiment shown in FIG. 9, the reference numbers of the preceding figures have been retained for the unchanged components. The grip sleeve or grip 10 is again stayed via spring and damping elements 13 and 14 at spars 5 and 6, in which the spring and damping elements are again placed adjacent to one another in recesses extending in longitudinal direction of the grip 2 and shaft of the spars 5, 6. In this embodiment, the grip sleeve 10 is fixed to prevent axial shifting relative to the spars 5 and 6 by an elastic pin, passing through the grip sleeve 10, inserted in an opening or bore 20, or an inserted elastic screw 21 which consist, for example, of polyamide. The screw or pin 21 thereby penetrates, at least partially, into the immediately adjacent spar, whereby it is ensured that the grip sleeve 10 can be disconnected to a great extent from the spars 5 and 6 by the use of an elastic screw or an elastic pin and the spring and damping properties of the spring or damping elements 13 and 14 are in no way influenced.

Figure 11:
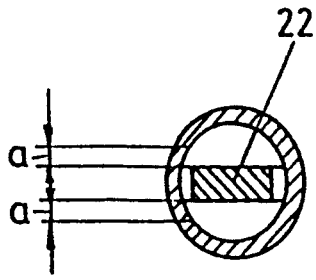
FIG. 11 shows a section along the line XI—XI of FIG. 10.
Figure 10:
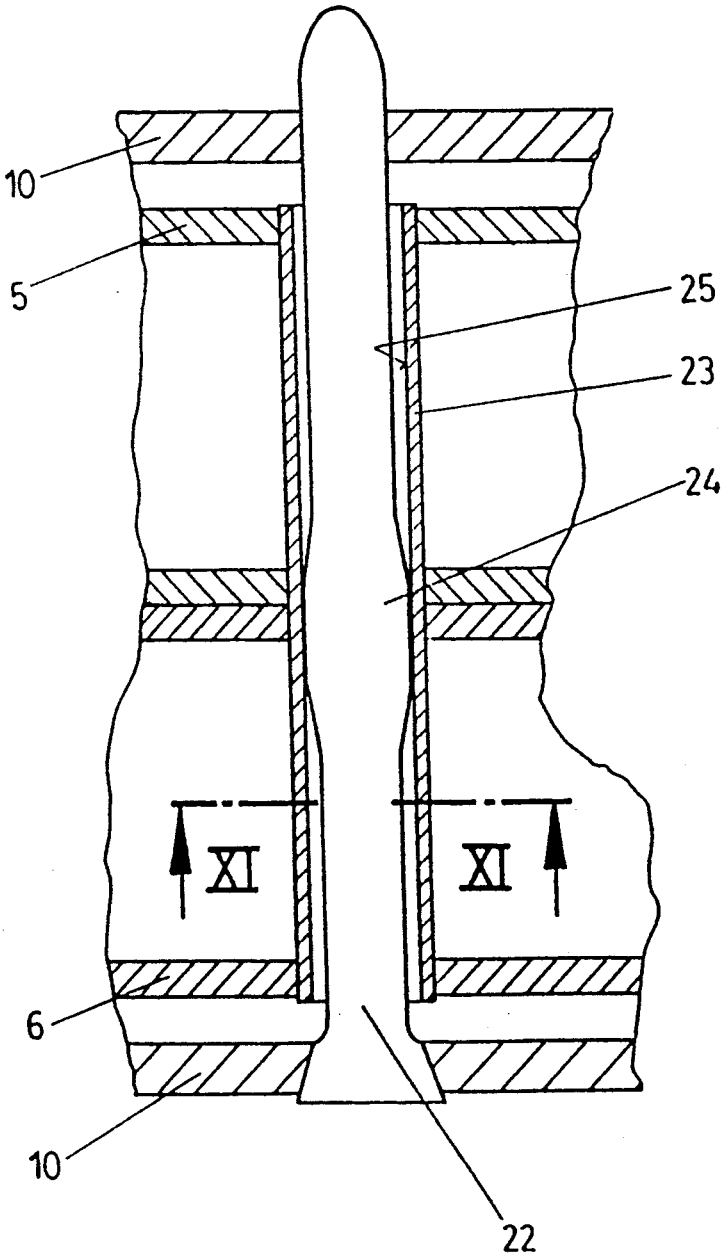
FIG. 10, on a greatly enlarged scale, shows a section through the grip in a normal plane on the racquet axis through a modified embodiment for fixing the grip.

FIGS. 10 and 11 show a modified embodiment for fixing the grip sleeve or grip 10 to the spars 5 and 6. It can be seen in the section through a locking pin or locking peg 22 shown in FIG. 10 in a normal plane on the longitudinal axis of the shaft and grip 10 that a sleeve 23, which consists e.g. of a metal, is inserted diagonally to the longitudinal axis of the racquet into the spars 5, 6 of the shaft and are fixed therein. After the grip sleeve 10 has been slid onto the frame spars 5 and 6, the locking pin or peg 22, having an essentially rectangular cross-section, is pushed into the sleeve 23, in which the cross-sectional form of the pin 22 can be clearly seen, in particular, in FIG. 11. The pin or peg 22, which can e.g. have a height of about 1 mm, merely lies adjacent in its middle area 24 to the inside wall 25 of the sleeve 23 and is tapered or constructed with a slighter longitudinal reach at its end areas vis-a-vis the middle area 24 and, therefore, spaced from the inside wall 25 of the sleeve 23. In this case, pin 22 extends through a corresponding slot in the grip sleeve 10 and is thus protected against turning. As a result of the fact that the pin 22 only lies adjacent to the inside wall 25 of the sleeve 23 in a partial area 24, a limited rotation is made possible, whereby the play for the movement of the pin or peg 22 is designated with a in FIG. 11. As a result, the grip sleeve 10 is disconnected from the spars 5 and 6, so that the spring and damping properties of the spring or damping elements 13 and 14 are not influenced.

I claim:

1. A racquet for a ball game comprising:

a grip portion overlying a shaft connected to a head having a striking surface, said grip and said shaft having a longitudinal axis, and wherein said head is rotatable to a limited degree about said longitudinal axis and relative to said grip; and further wherein said shaft is formed with at least one longitudinal recess extending substantially parallel to said longitudinal axis, with at least one spring element and at least /ne damping element located adjacent each other in said at least one recess, and in engagement with said grip.

2. The racquet according to claim 1 wherein each spring element and each damping element have a pair of lateral faces which lie in planes convergent in a direction toward said longitudinal axis.

3. The racquet according to claim 2 wherein said grip is formed with at least one face surface engaged by one of said pair of lateral faces of said spring element and one of said pair of lateral faces of said damping element, and wherein said at least one longitudinal recess is formed with another surface engaged by the other of said pair of lateral faces of said spring element and the other of said pair of lateral faces of said damping element.

4. A racquet according to claim 1, wherein said at least one spring element is comprised of an elastomeric material, and wherein said at least one damping element is comprised of synthetic rubber of a lesser Shore hardness than said at least one spring element.

5. A racquet according to claim 1, wherein said at least one spring element has an axial length less than a corresponding axial length of said at least one damping element.

6. A racquet according to claim 5, wherein a ratio of the length of said at least one spring element to the length of said at least one damping element is about 1:2.

7. A racquet according to claim 2, wherein a base angle of said pair of lateral faces of each said spring element and said damping element lies between 82° and 89.5°.

8. A racquet according to claim 1, wherein said at least one longitudinal recess has an axial length greater than a sum of the lengths of the spring and damper elements located therein.

9. A racquet according to claim 1, wherein said at least one spring element is made of a material having a hardness (Shore A) to 78 to 88, and wherein said at least one damping element is made of a material having a hardness (Shore A) of 50 to 60.

10. A racquet according to claim 1, wherein a spring and an adjacent damping element are located in axially spaced paired relationship at each of two axial ends of said at least one longitudinal recess.

11. A racquet according to claim 1, wherein said grip is connected to said shaft, only via said at least one spring element and said at least one damping element.

12. A racquet according to claim 3, wherein a shear-resistant adhesive is used to secure said at least one spring element and said at least one damper element to said at least one face surface of said grip to provide protection against axial shifting of the grip relative to the shaft.

13. A racquet according to claim 1, wherein said shaft and said grip are connected to one another by pins or screws to protect against axial shifting of said shaft and said grip relative to one another.

14. A racquet according to claim 13, wherein said pins or screws are elastic and are made of polyamide.

15. A racquet according to claim 13, wherein a sleeve is placed in apertures in the shaft and a locking pin is inserted in said sleeve and comes into contact with an inside wall of the sleeve in partial areas, said locking pin being held in openings in the grip so as to be immovable.

* * * * *